United States Patent [19]

Besaw

[11] 3,947,988

[45] Apr. 6, 1976

[54] PORTABLE RIFLE REST

[76] Inventor: Joseph W. Besaw, 1417 7th Ave. NW., Austin, Minn. 55912

[22] Filed: Dec. 26, 1974

[21] Appl. No.: 536,571

[52] U.S. Cl. ..... 42/94

[51] Int. Cl.[2] ..... F41C 29/00

[58] Field of Search ..... 42/94; 248/159, 157, 163, 248/165, 166, 439; 89/37 BA

[56] References Cited

UNITED STATES PATENTS

| | | | |
|---|---|---|---|
| 3,012,350 | 12/1961 | Wold | 42/94 |
| 3,041,938 | 7/1962 | Seabrook | 42/94 |
| 3,225,656 | 12/1965 | Flaherty et al. | 42/94 |
| 3,608,225 | 9/1971 | Manuel | 42/94 |
| 3,711,984 | 1/1973 | Dyer et al. | 42/94 |
| 3,827,172 | 8/1974 | Howe | 42/94 |

*Primary Examiner*—Charles T. Jordan

*Attorney, Agent, or Firm*—Burd, Braddock & Bartz

[57] ABSTRACT

A portable rifle rest useful for zeroing in rifles on or off a rifle range includes an elongated, upper rifle support block provided with a V-shape rifle support notch therein lined with cushioning material, and two elongated lower foot blocks each pivotally mounted to the upper block to move between positions at right angles thereto when the rifle rest is in use and positions aligned therewith when the rifle rest is to be transported like a suitcase. One of the foot blocks is provided with bullet receiving receptacles on both ends thereof, and the other foot block is hollow and open to the top when these blocks are in position for use. Adjustable legs extend downwardly from each of the foot blocks to provide ability to level and to give additional height. The rifle rest is provided with a flexible handle extending symmetrically over the V-shaped notch for use in carrying the rifle rest when it is in the transport position, this handle moving out of the way below the notch when the rifle rest is in the position for use.

5 Claims, 4 Drawing Figures

FIG. 1
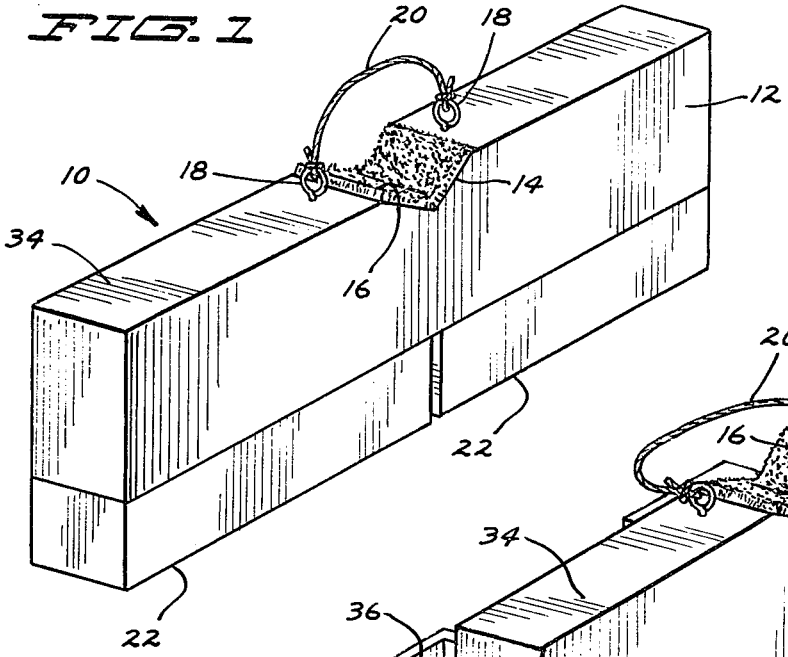
FIG. 2
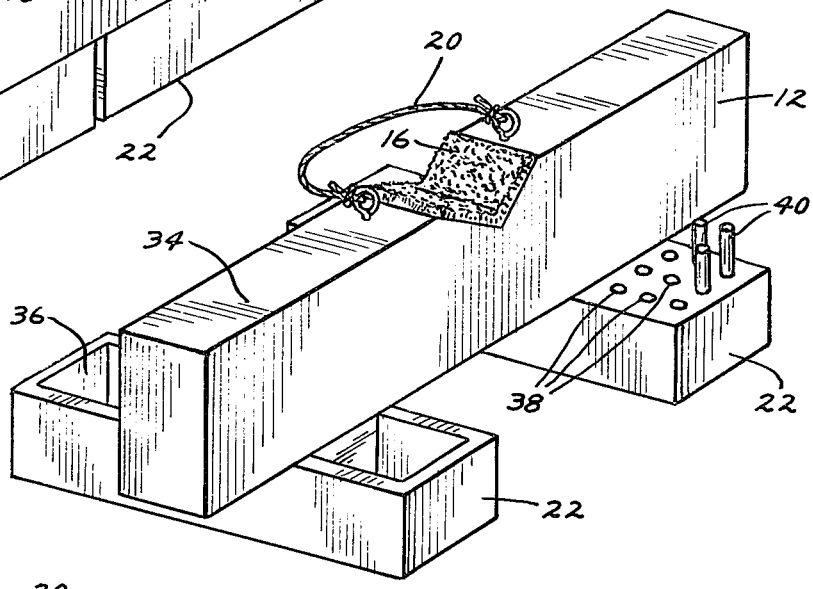
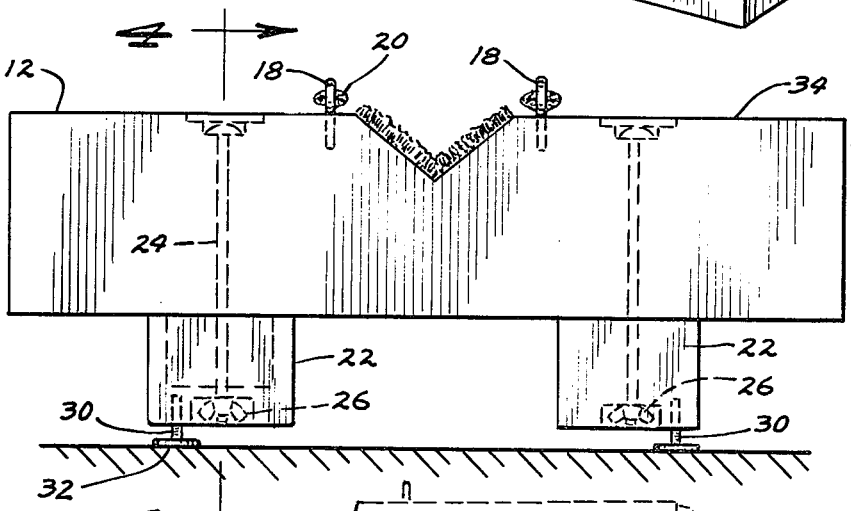
FIG. 3
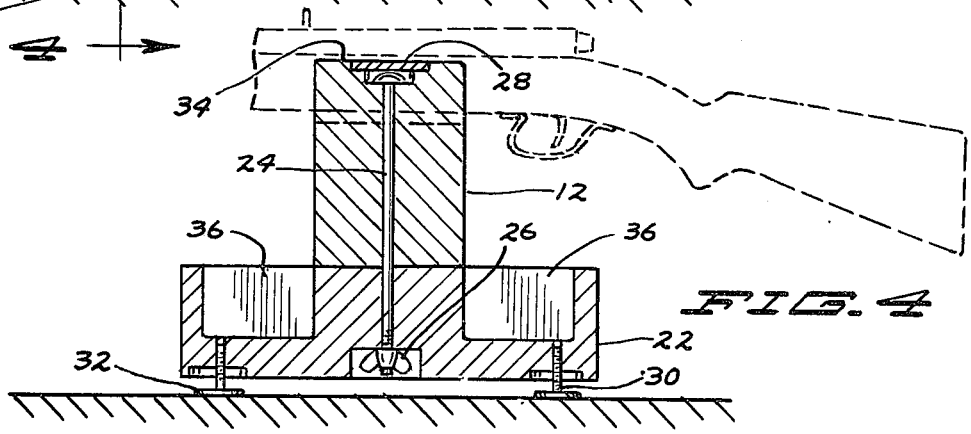
FIG. 4

PORTABLE RIFLE REST

BACKGROUND OF THE INVENTION

This invention has relation to portable rifle rests used for steadily and solidly supporting a rifle or other similar firearm in the process of zeroing in the bore of the rifle with respect to the gun sights thereof or for any other purpose.

Customarily, this support is provided by the manufacturer or other professional by elaborate clamps, vices, and other holding means, during the manufacture or overhaul of the gun. However, for use in the field, bean bags or sand bags have to be built up to accomplish this purpose. The present invention presents a portable rifle rest which will be most useful to a person wanting to zero in or sight in his rifle in the field.

Other portable rifle rests have been suggested such as those shown in U.S. Pat. No. 3,772,813 granted on Nov. 20, 1973 to Sands, and U.S. Pat. No. 3,711,984 granted on Jan. 23, 1973 to Dyer et al.

The Sands patent provides but a single narrow cushioned V-shaped rod to support the rifle, thus making the so-called rifle shooting stand merely a guide or a positioning member and not truly a "rest" capable of supporting the gun without further outside supports.

The patent to Dyer discloses a very involved and complicated nesting contraption which can be taken apart and laboriously built up to provide a horizontal pad on which a gun can be rested in adjacent relationship to a telescope or other sighting device or the like. It suffers from the severe drawbacks of being extremely expensive to manufacture and extremely time consuming to put into place for operation, and from having no convenient adjacent location where bullets, shells, tools and scopes and the like can be stored.

To provide a portable gun rest which is selectively almost instantaneously "set up" and "knocked down", and to overcome the problems with gun stands and shooting benches of the prior art, the present portable rifle rest was invented.

BRIEF SUMMARY OF THE INVENTION

A portable rifle rest forms a package similar to the shape of a suitcase when not in use, and is carried by a handle, symmetrically positioned along the top edge thereof. The rifle rest includes an elongated upper block forming an upper portion of the suitcase-like structure, this block being provided with a V-shaped notch extending symmetrically into this upper edge to be transverse to the maximum longitudinal dimension of the block. In the form of invention shown, this V-shaped notch is lined with resilient material to receive and cushion a rifle when the rest is in use.

The lower portion of the suitcase-like structure includes two elongated symmetrical foot blocks each pivotally mounted on a vertical axis through its center portion to the underside of the upper block and movable between a portable or transport position in longitudinal alignment with each other and with the major horizontal longitudinal axis of the upper block and a use position wherein both foot blocks are at right angles to the upper block. Adjustable pivot means are provided, in the form of elongated bolts and wing nuts as shown, to hold the foot blocks in either the transport or the use positions as desired.

As shown, the symmetrically placed handle is movable from a position across and above the V-shaped notch when the rifle rest is being carried or transported to a position clear of alignment with and below the lowermost surfaces of that notch when the rifle rest is in its use or rifle sighting position.

In the form of invention as shown, four adjustable legs are provided, two on the bottom of each foot block, for leveling the rifle rest and/or for providing more height for the V-shaped notch with respect to the surface on which the portable rifle rest is supported when in use.

IN THE DRAWINGS

FIG. 1 is a perspective view of a portable rifle rest of the invention in its portable or transport position;

FIG. 2 is a perspective view of the rifle rest of FIG. 1 but in its use or rifle sighting position;

FIG. 3 is an elevational view of the rifle rest as seen in FIG. 2 from the right front of that figure; and FIG. 4 is a vertical sectional view on line 4—4 in FIG. 3 and showing in phantom a rifle positioned for sighting on the rifle rest.

DESCRIPTION OF PREFERRED EMBODIMENT

A portable rifle rest 10 includes an elongated upper rifle support block 12 which is provided with a V-shaped rifle support notch 14 for receiving a center portion of a rifle to be sighted or zeroed in. A relatively soft cushion 16 lines the faces of this notch 14. Eye rings 18,18 are provided in a normally horizontal upper surface 34 of the upper block 12 to support a flexible handle 20 of leather or other suitable material for carrying the portable rifle rest when in a portable or transport position as seen in FIG. 1. This handle moves to position below alignment with the lowermost surfaces of the V-shaped notch 14 when the rifle rest is in its use position as seen in FIG. 2. As shown the eye rings 18 extend upwardly from the surface 34 of the upper block 12, but they could just as well be recessed into the block.

The portable rifle rest 10 also includes a pair of foot blocks 22,22, each pivotally mounted on vertical pivots below and with respect to upper block 12 through the instrumentality of elongated bolts 24 and wing nuts 26. As shown, the heads of the bolts 24 are countersunk in upper block 12 while the space for the wing nuts is provided in a countersunk portion of each of the lower foot blocks 22. A wood veneer disc 28 closes the countersunk opening in block 12, in the form of the invention as shown. Blocks 12 and 22 can be of wood, plastic or other suitable material.

A plurality of legs 30 are threadably mounted in bottom corners of each of the foot blocks 22, and each such leg is provided with a pad 32 thereon. These legs can be adjusted to level the upper surface 34 of the upper block 12 when the surface on which the rifle rest is not flat or horizontal.

As best seen in FIGS. 2, 3 and 4, the foot block 22 to the left in FIGS. 2 and 3 is hollow and open to the top to provide boxes 36 to store articles needed or helpful to the sighting in operation. As shown, the portion of this foot block 22 which remains under the upper block 12 as the foot block rotates is solid, but it is to be understood that even this portion could be hollowed out in the center. This would provide even more storage space for the tools used for sights and scopes. The foot block to the right in FIGS. 2 and 3 is provided with bullet receptacles 38 where the bullets to be used in firing and zeroing in the rifle are placed. As shown, two sets of receptacles, each for nine bullets are provided, but receptacles for a full dozen cartridges could be provided on each side of the upper block 12. The depth of the receptacle holes can be adapted to the particular ammunition used, or the holes can be drilled to a uniform depth with sponge rubber being provided to position a particular cartridge at a convenient height for use without disturbing the rifle.

OPERATION

After positioning the portable rifle rest 10 adjacent the desired location for use, whether this be on the ground, on a table, on the hood of a car, or elsewhere, while the rest is in its portable or transport position as seen in FIG. 1; the wing nuts 26 will be loosened sufficiently to let the foot blocks be manually turned to position as seen in FIGS. 2, 3 and 4, thus placing the portable rifle rest 10 in the use or rifle sighting position. The wing nuts can then again be tightened to maintain the rifle rest 10 in this position while it is in use for its intended purpose.

The legs 30 will be rotated as necessary to level the rifle rest. This leveling can be expedited by placing a spirit level on upper surface 34 of the upper block 12.

In the case of a righthanded shooter, the shooter will take his position to the right and forwardly as seen in FIG. 2, and sufficient bullets 40 to be used in zeroing in or sighting the rifle will be placed in the bullet receptacles 38 in block 22. If the shooter is lefthanded, the entire portable rifle rest 10 is rotated 180°, so that the bullets can be placed in bullet receptacles 38 at the other end of the block 22, thus to be convenient to him.

A rifle such as indicated in phantom at 42 will be balanced in the notch 14 and the zeroing or sighting process is then performed in any usual or preferred manner.

When the portable rifle rest 10 has served its intended purpose in this manner, wing nuts 26 will again be loosened, the remaining bullets 40 removed from bullet receptacles 38, and the foot blocks returned to position as seen in FIG. 1. The wing nuts 26 are again tightened, the legs 30 are rotated to again recess pads 32 into the bottom of the foot blocks 22, and the portable rifle rest is again in its transport or portable position and can be carried away and stored until such time as it again is needed.

The embodiments of the invention in which an exclusive property or privilege is claimed are defined as follows:

1. A portable gun rest for use on a supporting surface including:

A. an elongated upper block;

B. a pair of elongated lower foot blocks depending from below said upper block;

C. means for pivotally mounting at least one of said foot blocks on a vertical axis to move between a transport position in alignment with said upper block and a use position transverse thereof; and D. said upper block being provided with an upwardly opening notch adapted to support a gun in a generally horizontal position.

2. The portable gun rest of claim 1 wherein said upper block and lower blocks are each rectilinear in shape and together form a larger overall generally rectilinear shape when the blocks are in the use position.

3. The portable gun rest of claim 2 wherein said upwardly opening notch is V-shaped and wherein a cushion covers its upwardly opening surfaces.

4. The portable gun rest of claim 3 wherein:

A. both of said foot blocks are pivotally mounted to depend from the upper block;

B. a handle is symmetrically fastened with respect to an upper surface of said upper block to extend across said notch when used to lift said gun rest;

C. means is provided to selectively temporarily fasten said blocks in said transport position and in said use position; and D. one of said foot blocks is provided with a plurality of upwardly open bullet receptacles in at least one end thereof.

5. The portable gun rest of claim 4 wherein said handle is movable to a position entirely below horizontal alignment with the surface of the V-shaped notch; and wherein there are adjustable length legs extending downwardly from at least one of said foot blocks, said legs being adapted to position said gun rest on the level on a supporting surface and to support the remainder of the gun rest at least partly in spaced relation above said supporting surface.

* * * * *